US007625463B2

(12) United States Patent
Weerawarna et al.

(10) Patent No.: US 7,625,463 B2
(45) Date of Patent: Dec. 1, 2009

(54) METHODS FOR THE PREPARATION OF FIBROUS SUPERABSORBENT COMPOSITE CONTAINING CELLULOSE

(75) Inventors: S. Ananda Weerawarna, Seattle, WA (US); Su Bing, Federal Way, WA (US)

(73) Assignee: Weyerhaeuser NR Company, Federal Way, WA (US)

( * ) Notice: Subject to any disclaimer, the term of this patent is extended or adjusted under 35 U.S.C. 154(b) by 487 days.

(21) Appl. No.: 11/537,982

(22) Filed: Oct. 2, 2006

(65) Prior Publication Data

US 2008/0078515 A1 Apr. 3, 2008

(51) Int. Cl.
*D21H 11/16* (2006.01)
*D21H 11/18* (2006.01)
*D21H 13/28* (2006.01)

(52) U.S. Cl. ..... 162/175; 162/178; 162/185; 162/187

(58) Field of Classification Search ..... 162/175, 162/178, 185, 187; 106/140.2, 144.3; 536/43, 536/52

See application file for complete search history.

(56) References Cited

U.S. PATENT DOCUMENTS

| | | | | |
|---|---|---|---|---|
| 2,913,364 | A * | 11/1959 | Miller et al. | 162/178 |
| 3,645,836 | A | 2/1972 | Torr | |
| 4,028,290 | A | 6/1977 | Reid | |
| 4,128,692 | A * | 12/1978 | Reid | 428/378 |
| 4,143,163 | A | 3/1979 | Hutchison et al. | |
| 4,273,118 | A | 6/1981 | Smith | |
| 4,319,956 | A | 3/1982 | Snyder et al. | |
| 4,605,401 | A | 8/1986 | Chemilir et al. | |
| 4,624,868 | A | 11/1986 | Muller | |
| 4,693,713 | A | 9/1987 | Chmelir | |
| 4,952,550 | A | 8/1990 | Wallach et al. | |
| 4,959,341 | A | 9/1990 | Wallach | |
| 5,231,122 | A | 7/1993 | Palumbo et al. | |
| 5,425,725 | A | 6/1995 | Tanzer et al. | |
| 5,470,964 | A | 11/1995 | Qin | |
| 5,498,705 | A | 3/1996 | Qin | |
| 5,550,189 | A | 8/1996 | Qin et al. | |
| 5,612,411 | A | 3/1997 | Gross | |
| 5,688,776 | A | 11/1997 | Bauer et al. | |
| 5,736,595 | A | 4/1998 | Gunther et al. | |
| 5,801,116 | A | 9/1998 | Cottrell et al. | |
| 5,847,031 | A * | 12/1998 | Klimmek et al. | 524/44 |

(Continued)

FOREIGN PATENT DOCUMENTS

| | | |
|---|---|---|
| WO | WO 00/21581 | 4/2000 |

(Continued)

OTHER PUBLICATIONS

Peters, Dry Strength Alternatives: CMC and Guar Gum, 2002, Tappi/Hercules, whole document.*

*Primary Examiner*—Eric Hug
*Assistant Examiner*—Anthony J Calandra
(74) *Attorney, Agent, or Firm*—John M. Crawford

(57) ABSTRACT

A method for making a fibrous composite, comprising blending a carboxyalkyl cellulose and a galactomannan polymer or a glucomannan polymer in water to provide an aqueous solution; treating the aqueous solution with a first crosslinking agent to provide a gel; drying the gel to provide a solid; comminuting the solid to provide a plurality of particles; combining at least a portion of the plurality of particles with an aqueous suspension comprising cellulose treated with a galactomannan polymer or a glucomannan polymer, and optionally a second crosslinking agent, to provide a mixture; and mixing the mixture with a water-miscible solvent to provide a fibrous composite.

18 Claims, 4 Drawing Sheets

U.S. PATENT DOCUMENTS

| | | | | |
|---|---|---|---|---|
| 6,162,541 | A | 12/2000 | Chou et al. | |
| 6,296,936 | B1 | 10/2001 | Yahiaoui et al. | |
| 6,331,619 | B1 * | 12/2001 | Besemer et al. | 536/105 |
| 6,562,743 | B1 | 5/2003 | Cook et al. | |
| 6,689,934 | B2 | 2/2004 | Dodge, II et al. | |
| 6,713,460 | B2 | 3/2004 | Huppe | |
| 6,765,042 | B1 | 7/2004 | Thornton et al. | |
| 6,846,924 | B1 | 1/2005 | Malmgren et al. | |
| 6,998,367 | B2 | 2/2006 | Qin | |
| 7,306,039 | B2 | 12/2007 | Wang et al. | |
| 7,321,007 | B2 | 1/2008 | Gagliardi et al. | |
| 7,407,912 | B2 | 8/2008 | Mertens et al. | |
| 2003/0027787 | A1 | 2/2003 | Couture et al. | |
| 2003/0068944 | A1 | 4/2003 | Carlucci et al. | |
| 2003/0144642 | A1 | 7/2003 | Dopps et al. | |
| 2003/0232965 | A1 * | 12/2003 | Bergeron | 530/300 |
| 2004/0024092 | A1 | 2/2004 | Sorens et al. | |
| 2004/0236260 | A1 | 11/2004 | Griffiths et al. | |
| 2005/0214541 | A1 | 9/2005 | Berrada et al. | |
| 2006/0142477 | A1 | 6/2006 | Glasser | |
| 2006/0147689 | A1 | 7/2006 | Wallajapet et al. | |
| 2007/0179291 | A1 | 8/2007 | Thibodeau et al. | |
| 2008/0009616 | A1 | 1/2008 | Frank et al. | |
| 2008/0078514 | A1 | 4/2008 | Weerawarna et al. | |
| 2008/0078515 | A1 | 4/2008 | Weerawarna et al. | |
| 2008/0079187 | A1 | 4/2008 | Weerawarna et al. | |
| 2008/0079188 | A1 | 4/2008 | Weerawarna et al. | |
| 2008/0081165 | A1 | 4/2008 | Weerawarna et al. | |
| 2008/0081189 | A1 | 4/2008 | Weerawarna et al. | |
| 2008/0081190 | A1 | 4/2008 | Weerawarna et al. | |
| 2008/0081191 | A1 | 4/2008 | Weerawarna et al. | |
| 2008/0081843 | A1 | 4/2008 | Weerawarna et al. | |
| 2008/0082064 | A1 | 4/2008 | Luo et al. | |
| 2008/0082065 | A1 | 4/2008 | Weerawarna et al. | |
| 2008/0082067 | A1 | 4/2008 | Weerawarna et al. | |

FOREIGN PATENT DOCUMENTS

| | | |
|---|---|---|
| WO | WO 2005/123781 | 12/2005 |
| WO | WO 2006/079221 | 8/2006 |
| WO | WO 2006/119638 | 11/2006 |

* cited by examiner

METHODS FOR THE PREPARATION OF FIBROUS SUPERABSORBENT COMPOSITE CONTAINING CELLULOSE

BACKGROUND OF THE INVENTION

Personal care absorbent products, such as infant diapers, adult incontinent pads, and feminine care products, typically contain an absorbent core that includes superabsorbent polymer particles distributed within a fibrous matrix. Superabsorbents are water-swellable, generally water-insoluble absorbent materials having a high absorbent capacity for body fluids. Superabsorbent polymers (SAPs) in common use are mostly derived from acrylic acid, which is itself derived from petroleum oil, a non-renewable raw material. Acrylic acid polymers and SAPs are generally recognized as not being biodegradable. Despite their wide use, some segments of the absorbent products market are concerned about the use of non-renewable petroleum oil derived materials and their non-biodegradable nature. Acrylic acid based polymers also comprise a meaningful portion of the cost structure of diapers and incontinent pads. Users of SAP are interested in lower cost SAPs. The high cost derives in part from the cost structure for the manufacture of acrylic acid which, in turn, depends upon the fluctuating price of petroleum oil. Also, when diapers are discarded after use they normally contain considerably less than their maximum or theoretical content of body fluids. In other words, in terms of their fluid holding capacity, they are "over-designed". This "over-design" constitutes an inefficiency in the use of SAP. The inefficiency results in part from the fact that SAPs are designed to have high gel strength (as demonstrated by high absorbency under load or AUL). The high gel strength (upon swelling) of currently used SAP particles helps them to retain a lot of void space between particles, which is helpful for rapid fluid uptake. However, this high "void volume" simultaneously results in there being a lot of interstitial (between particle) liquid in the product in the saturated state. When there is a lot of interstitial liquid the "rewet" value or "wet feeling" of an absorbent product is compromised.

In personal care absorbent products, U.S. southern pine fluff pulp is commonly used in conjunction with the SAP. This fluff is recognized worldwide as the preferred fiber for absorbent products. The preference is based on the fluff pulp's advantageous high fiber Length (about 2.8 mm) and its relative ease of processing from a wetland pulp sheet to an airlaid web. Fluff pulp is also made from renewable and biodegradable cellulose pulp fibers. Compared to SAP, these fibers are inexpensive on a per mass basis, but tend to be more expensive on a per unit of liquid held basis. These fluff pulp fibers mostly absorb within the interstices between fibers. For this reason, a fibrous matrix readily releases acquired liquid on application of pressure. The tendency to release acquired liquid can result in significant skin wetness during use of an absorbent product that includes a core formed exclusively from cellulosic fibers. Such products also tend to leak acquired liquid because liquid is not effectively retained in such a fibrous absorbent core.

Superabsorbent produced in fiber form has a distinct advantage over particle forms in some applications. Such superabsorbent fiber can be made into a pad form without added non superabsorbent fiber. Such pads will also be less bulky due to elimination or reduction of the non superabsorbent fiber used. Liquid acquisition will be more uniform compared to a fiber pad with shifting superabsorbent particles.

A need therefore exists for a fibrous superabsorbent material that is simultaneously made from a biodegradable renewable resource like cellulose that is inexpensive. In this way, the superabsorbent material can be used in absorbent product designs that are efficient. These and other objectives are accomplished by the invention set forth below.

SUMMARY OF THE INVENTION

The invention provides a method for making a fibrous composite, comprising blending a carboxyalkyl cellulose and either a galactomannan polymer or glucomannan polymer in water to provide an aqueous solution; treating the aqueous solution with a first crosslinking agent to provide a gel; drying the gel to provide a solid; comminuting the solid to provide a plurality of particles; combining at least a portion of the plurality of particles with an aqueous suspension comprising cellulose treated with a galactomannan polymer or a glucomannan polymer, and optionally a second crosslinking agent, to provide a mixture; and mixing the mixture with a water-miscible solvent to provide a fibrous composite.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE INVENTION

Figure 1:
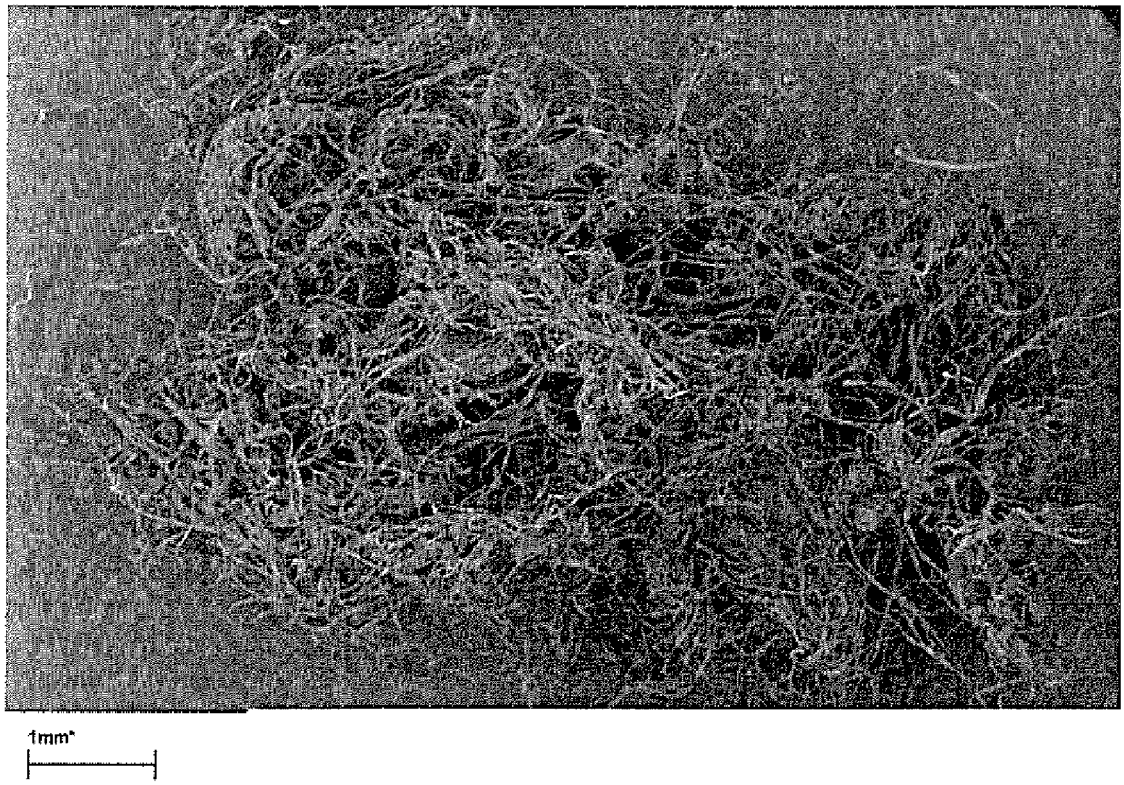
FIG. 1 is a scanning electron microscope photograph (13×) of a representative fibrous superabsorbent composite containing cellulose (Sample 14, Table 2)

In one aspect, the present invention provides a method for making a fibrous superabsorbent composite containing cellulose. The method includes the steps of (a) blending a carboxyalkyl cellulose and either a galactomannan polymer or a glucomannan polymer in water to provide an aqueous solution; (b) treating the aqueous solution with a first crosslinking agent to provide a gel; (c) drying the gel to provide a solid; (d) comminuting the solid to provide a plurality of particles; (e) combining at least a portion of the plurality of particles with an aqueous suspension comprising cellulose treated with a galactomannan polymer or a glucomannan polymer, and optionally a second crosslinking agent, in water to provide a mixture; and mixing the mixture with a water-miscible solvent to provide a fibrous composite. The fibrous composite can be obtained by filtration. The method can further include drying the fibrous composite to provide partially-dried fibrous composite (30-50% consistency). The partially-dried fibrous composite can be fiberized to provide partially-dried fiberized fibrous composite. The partially-dried fiberized fibrous composite can be further dried to provide dried fiberized fibrous composite.

In the process, a carboxyalkyl cellulose and either a galactomannan polymer or a glucomannan polymer are blended in water to provide an aqueous solution. Suitable carboxyalkyl celluloses have a degree of carboxyl group substitution of from about 0.3 to about 2.5, and in one embodiment have a degree of carboxyl group substitution of from about 0.5 to about 1.5. In one embodiment, the carboxyalkyl cellulose is carboxymethyl cellulose. The aqueous solution includes from about 60 to about 99% by weight carboxyalkyl cellulose based on the weight of the particle. In one embodiment, the aqueous solution includes from about 80 to about 95% by weight carboxyalkyl cellulose based on the weight of the particle.

The aqueous solution also includes a galactomannan polymer or a glucomannan polymer. Suitable galactomannan polymers include guar gum, locust bean gum, and tara gum. Suitable glucomannan polymers include konjac gum. The galactomannan polymer or glucomannan polymer can be from natural sources or obtained from genetically-modified plants. The aqueous solution includes from about 1 to about 20% by weight galactomannan polymer or glucomannan polymer based on the weight of the particles, and in one embodiment, the aqueous solution includes from about 1 to about 15% by weight galactomannan polymer or glucomannan polymer based on the weight of the particles.

In the method, the aqueous solution including the carboxyalkyl cellulose and galactomannan polymer or glucomannan polymer is treated with a first crosslinking agent to provide a gel.

Suitable first crosslinking agents include crosslinking agents that are reactive towards hydroxyl groups and carboxyl groups. Suitable first crosslinking agents include crosslinking agents that are reactive towards hydroxyl groups and carboxyl groups. Representative crosslinking agents include metallic crosslinking agents, such as aluminum (III) compounds, titanium (IV) compounds, bismuth (III) compounds, boron (III) compounds, and zirconium (IV) compounds. The numerals in parentheses in the preceding list of metallic crosslinking agents refers to the valency of the metal.

Representative metallic crosslinking agents include aluminum sulfate; aluminum hydroxide; dihydroxy aluminum acetate (stabilized with boric acid); other aluminum salts of carboxylic acids and inorganic acids; other aluminum complexes, such as Ultrion 8186 from Nalco Company (aluminum chloride hydroxide); boric acid; sodium metaborate; ammonium zirconium carbonate (AZC); zirconium compounds containing inorganic ions or organic ions or neutral ligands; bismuth ammonium citrate (BAC); other bismuth salts of carboxylic acids and inorganic acids; titanium (TV) compounds, such as titanium (IV) bis(triethylaminato) bis (isopropoxide) (commercially available from the Dupont Company under the designation Tyzor TE); and other titanates with alkoxide or carboxylate ligands.

The first crosslinking agent is effective for intermolecularly crosslinking the carboxyalkyl cellulose (with or without carboxyalkyl hemicellulose) and galactomannan polymer or glucomannan polymer molecules. The first crosslinking agent is applied in an amount of from about 0.1 to about 20% by weight based on the total weight of the particles.

The amount of crosslinking agent applied to the polymers will vary depending on the crosslinking agent. In general, the product fibrous composite has an aluminum content of about 0.01 to about 2.0% by weight based on the weight of the fibrous composite for aluminum crosslinked fibrous composite, a titanium content of about 0.01 to about 4.5% by weight based on the weight of the fibrous composite for titanium crosslinked fibrous composite, a zirconium content of about 0.01 to about 6.0% by weight based on the weight of the fibrous composite for zirconium crosslinked fibrous composite; and a bismuth content of about 0.01 to about 5% by weight based oln the weight of the fibrous composite for bismuth crosslinked fibrous composite.

The gel formed by treating the aqueous solution of a carboxyalkyl cellulose and a galactomannan polymer or glucomannan polymer with a first crosslinking agent is then dried to provide a solid that is then comminuted to provide a plurality of particles (superabsorbent particles). In one embodiment, the particles are sieved to obtain particles having a size of from about 150 to about 800 μm.

A portion of the plurality of particles (e.g., particles having a size of from about 150 to about 800 μm) is combined with an aqueous suspension of cellulose fibers that have been treated with a galactomannan polymer or a glucomannan polymer, and optionally a second crosslinking agent, to provide a mixture. The ratio of superabsorbent particles to cellulose treated with galactomannan polymer or glucomannan polymer is from about 50:50 to about 80:20 by weight of the fibrous composite. Representative galactomannan polymers include guar gum, locust bean gum, and tara gum. Representative glucomannan polymers include konjac gum. The treated cellulose includes from about 1 to about 20 percent by weight galactomannan polymer or glucomannan polymer based on the weight of cellulose.

Although available from other sources, suitable cellulosic fibers are derived primarily from wood pulp. Suitable wood pulp fibers for use with the invention can be obtained from well-known chemical processes such as the kraft and sulfite processes, with or without subsequent bleaching. Pulp fibers can also be processed by thermomechanical, chemithermomechanical methods, or combinations thereof. A high alpha cellulose pulp is also a suitable wood pulp fiber. The preferred pulp fiber is produced by chemical methods. Ground wood fibers, recycled or secondary wood pulp fibers, and bleached and unbleached wood pulp fibers can be used. Softwoods and hardwoods can be used. Suitable fibers are commercially available from a number of companies, including Weyerhaeuser Company. For example, suitable cellulosic fibers produced from southern pine that are usable with the present invention are available from Weyerhaeuser Company under the designations CF416, NF405, PL416, FR516, and NB416. Other suitable fibers include northern softwood and eucalyptus fibers.

The use of a crosslinking agent will depend on the nature of the superabsorbent particles to be adhered to the fibers. If the superabsorbent particles are highly crosslinked, added crosslinking agent is not required. However if the superabsorbent particles are not adequately crosslinked to provide sufficient insolubility in water, then the crosslinking agent is used.

Suitable second crosslinking agents include crosslinking agents that are reactive toward hydroxyl groups and carboxyl groups. The second crosslinking agent can be the same as or different from the first crosslinking agent. Representative second crosslinking agents include the metallic crosslinking agents noted above useful as the first crosslinking agents. The second crosslinking agent may be the same as or different from the first crosslinking agent. Mixtures of two or more crosslinking agents in different ratios may be used in each crosslinking step.

The second crosslinking agent is applied in an amount up to about 20 percent by weight based on the total weight of fibrous composite.

The mixture containing the treated cellulose, particles, and optional second crosslinking agent is then mixed with a water-miscible solvent to provide the fibrous composite. Suitable water-miscible solvents include water-miscible alcohols and ketones. Representative water-miscible solvents include acetone, methanol, ethanol, isopropanol, and mixtures thereof. In one embodiment, the water-miscible solvent is ethanol. In another embodiment, the water-miscible solvent is isopropanol.

The volume of water-miscible solvent added to the gel ranges from about 1:1 to about 1:5 water (the volume used in making the aqueous suspension of the treated cellulose and particles) to water-miscible solvent.

In the method, mixing the mixture with the water-miscible solvent includes stirring to provide the fibrous composite. The mixing step and the use of the water-miscible solvent controls the rate of dehydration and solvent exchange and provides for the fibrous composite. Mixing can be carried out using a variety of devices including overhead stirrers, Hobart mixers, British disintegrators, and blenders. For these mixing devices, the blender provides the greatest shear and the overhead stirrer provides the least shear.

The product fibrous composite can be obtained by filtration. In one embodiment, the wet fibrous composite is partially dried in an oven below 80° C. In one embodiment, the partially-dried composite fiber is then fiberized and dried in an oven below 80° C.

The fibrous superabsorbent composite containing cellulose prepared as described above includes a plurality of cellulose fibers treated with a galactomannan polymer or a glucomannan polymer to which are adhered superabsorbent particles derived from a combination of a carboxyalkyl cellulose and a galactomannan polymer or a glucomannan polymer.

The fibrous composite is prepared by a process that includes optionally treating an aqueous suspension of a plurality of particles (prepared by crosslinking a carboxyalkyl cellulose and a galactomannan polymer or a glucomannan polymer with a first crosslinking agent) and cellulose treated with a galactomannan polymer or a glucomannan polymer with a second crosslinking agent to provide a mixture, and then mixing the mixture with a water-miscible solvent.

The fibrous composite is substantially insoluble in water while being capable of absorbing water. The fibrous composite is rendered water insoluble, in part, by a plurality of non-permanent inter-polymer metal crosslinks.

The fibrous composite includes particles having intermolecular metal crosslinks between polymer molecules. The metal crosslink arises as a consequence of an associative interaction (e.g., bonding) between functional groups of the particle polymers (e.g., carboxy, carboxylate, or hydroxyl groups) and a multi-valent metal species (see description of crosslinking agents above). Suitable multi-valent metal species include metal ions having a valency of three or greater and that are capable of forming an associative interaction with a polymer (e.g., reactive toward associative interaction with the polymer's carboxy, carboxylate, or hydroxyl groups). The polymers are intermolecularly crosslinked when the multi-valent metal species forms an associative interaction with functional groups on two or more polymer molecules. A crosslink may be formed within one polymer molecule or may be formed between two or more polymer molecules. The extent of crosslinking affects the water solubility of the particles and the ability of the particles to swell on contact with an aqueous liquid.

The superabsorbent particles include non-permanent metal crosslinks formed both intermolecularly and intramolecularly in the population of polymer molecules. As used herein, the term "non-permanent crosslink" refers to the metal crosslink formed with two or more functional groups of a polymer molecule (intramolecularly) or formed with two or more functional groups of two or more polymer molecules (intermolecularly). It will be appreciated that the process of dissociating and re-associating (breaking and reforming crosslinks) the multi-valent metal ion and polymer molecules is dynamic and also occurs during liquid acquisition. During water acquisition the individual particles attached to treated cellulose swell and change to gel state. The ability of non-permanent metal crosslinks to dissociate and associate under water acquisition imparts greater freedom to the gels to expand than if it was restrictively crosslinked by permanent crosslinks that do not have the ability to dissociate and reassociate. Covalent organic crosslinks such as ether crosslinks are permanent crosslinks that do not have the ability to dissociate and reassociate.

Figure 2:
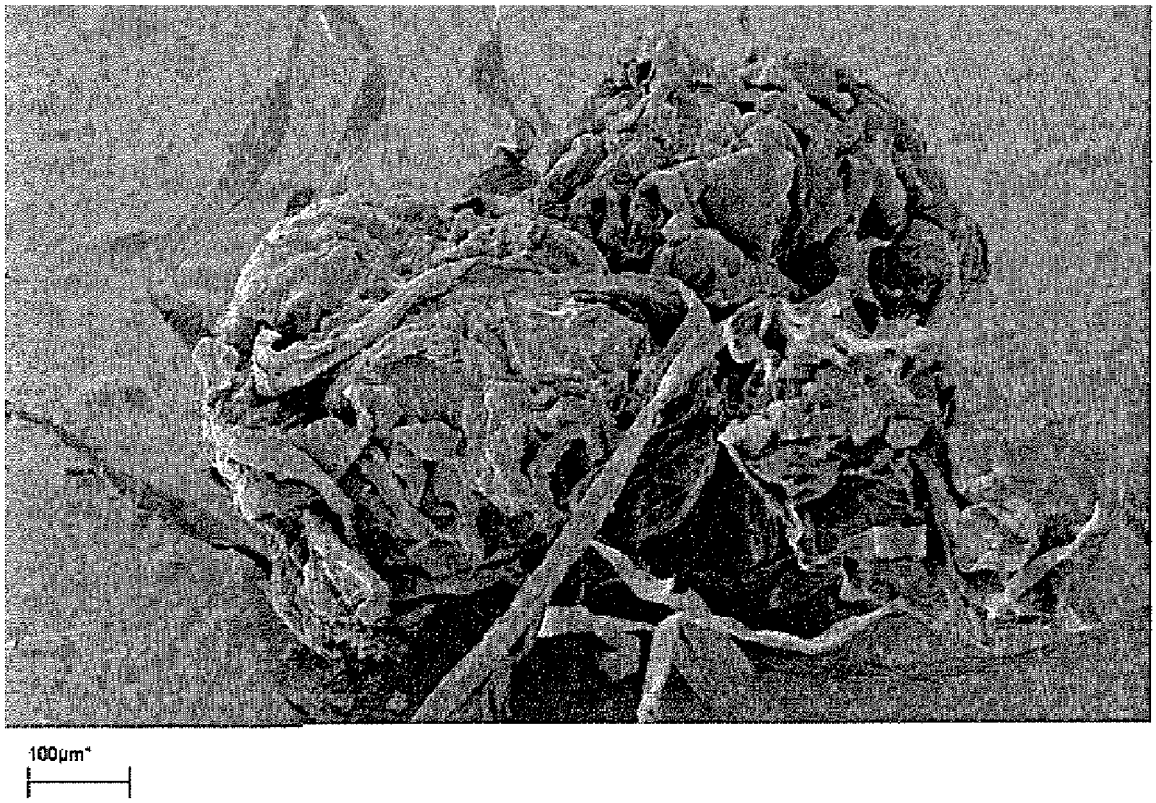
FIG. 2 is a scanning electron microscope photograph (100×) of a representative fibrous superabsorbent composite containing cellulose (Sample 14, Table 2)
Figure 3:
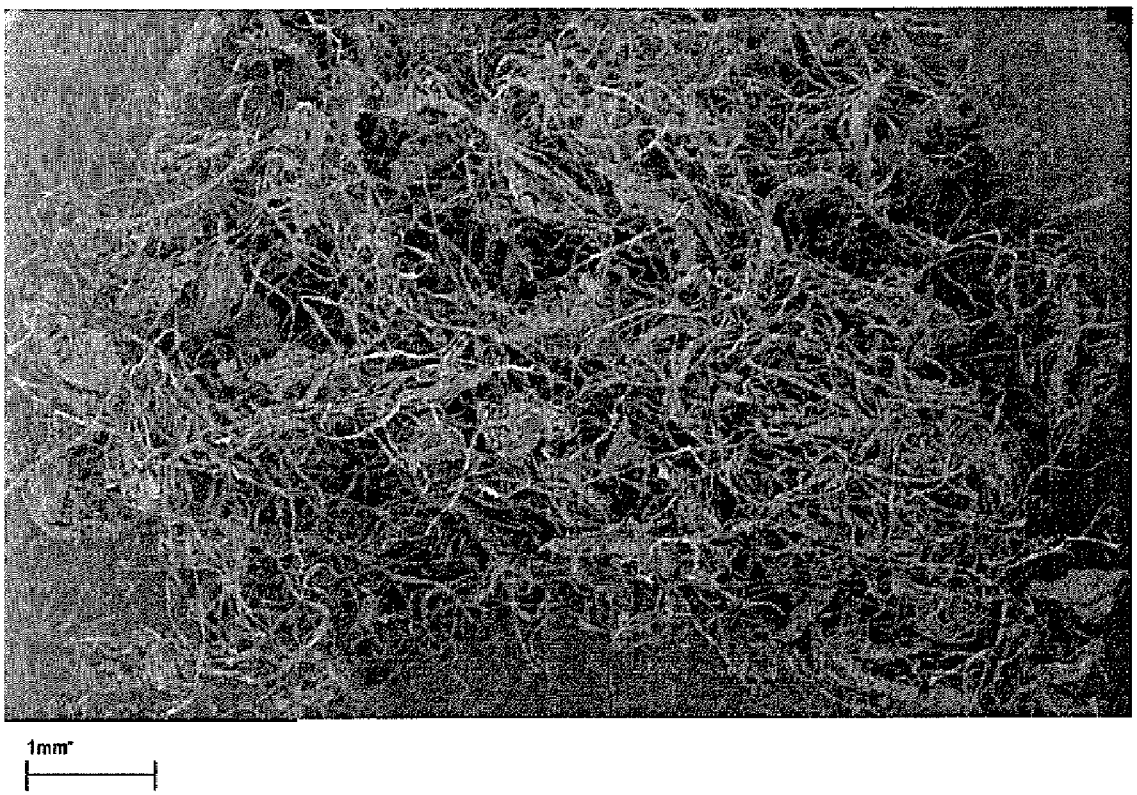
FIG. 3 is a scanning electron microscope photograph (13×) of a representative fibrous superabsorbent composite containing cellulose (Sample 15, Table 2)
Figure 4:
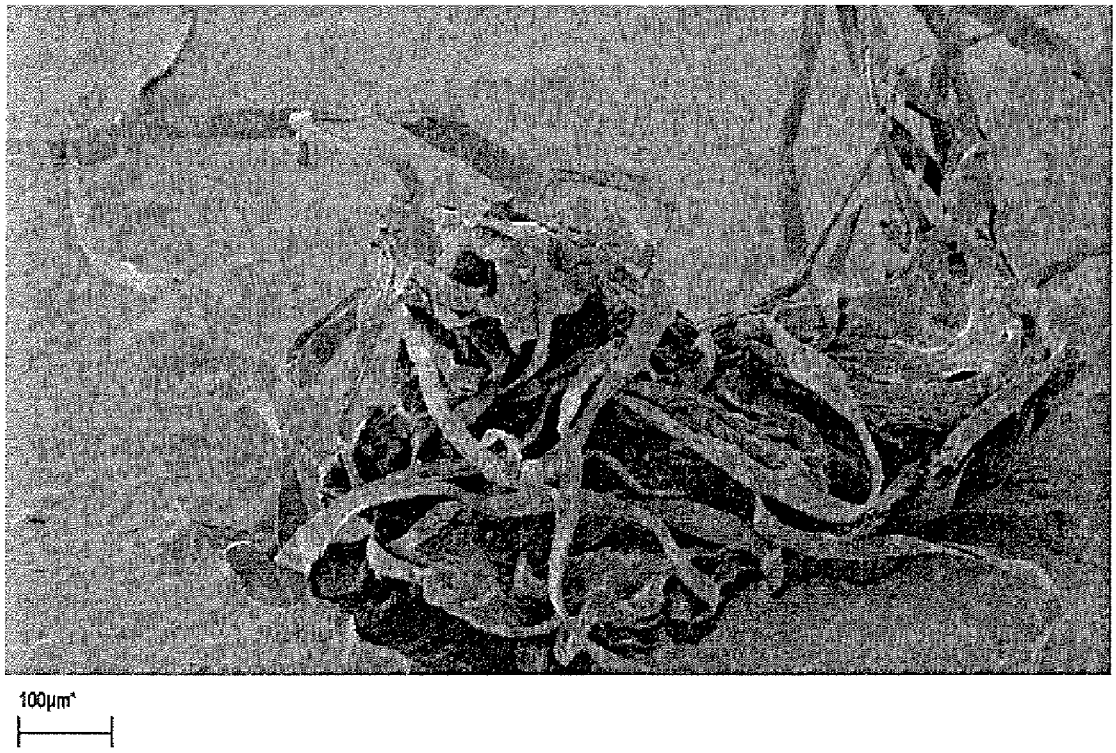
FIG. 4 is a scanning electron microscope photograph (100×) of a representative fibrous superabsorbent composite containing cellulose (Sample 15, Table 2).

Representative fibrous composites are shown in FIGS. 1-4. FIG. 1 is a scanning electron microscope photograph (13×) of a representative fibrous superabsorbent composite containing cellulose (Sample 14, Table 2). FIG. 2 is a scanning electron microscope photograph (100×) of a representative fibrous superabsorbent composite containing cellulose (Sample 14, Table 2). FIG. 3 is a scanning electron microscope photograph (13×) of a representative fibrous superabsorbent composite containing cellulose (Sample 15, Table 2). FIG. 4 is a scanning electron microscope photograph (100×) of a representative fibrous superabsorbent composite containing cellulose (Sample 15, Table 2).

The fibrous composite is highly absorptive. The composite has a Free Swell Capacity of from about 30 to about 60 g/g (0.9% saline solttion), a Centrifuge Retention Capacity (CRC) of from about 15 to about 35 g/g (0.9% saline solution), and an Absorbency Under Load (AUL) of from about 15 to about 30 g/g (0.9% saline solution).

The fibrous composite is water insoluble and water swellable. Water insolubility is imparted by intermolecular crosslinking of the polymer molecules, and water swellability is imparted to the absorbent particles by the presence of carboxylate anions with associated cations. The composite is characterized as having a relatively high liquid absorbent capacity for water (e.g., pure water or aqueous solutions, such as salt solutions or biological solutions such as urine). Furthermore, because the composite has a fibrous structure, the composite also possesses the ability to wick liquids.

The fibrous composite is useful as a superabsorbent in personal care absorbent products (e.g., infant diapers, feminine care products and adult incontinence products). Because of their ability to wick liquids and to absorb liquids, the composite is useful in a variety of other applications, including, for example, wound dressings, cable wrap, absorbent sheets or bags, and packaging materials.

The preparations of representative superabsorbent particles useful in adhering to cellulose fibers are described in Examples 1-6. In these examples solutions of a representative carboxyalkyl cellulose and a galactomannan polymer are crosslinked with a metallic crosslinking agent. The composition and liquid absorbent characteristics of representative superabsorbent particles (flakes) useful in the invention composites are summarized in Table 1. In Table 1, "% wgt total wgt, applied" refers to the amount of crosslinking agent applied to the total weight of CMC and guar gum; "CMC 9H4F" refers to a carboxymethyl cellulose commercially available from Hoechst Celanese under that designation; "PA-CMC" refers to CMC made from northern softwood pulp; "LB Gum" refers to locust bean gum; and "AZC" refers to ammonium zirconium carbonate.

The preparation of representative guar gum treated cellulose fibers is described in Example 7. In general, galactomannan or glucomannan polymer treated cellulose is prepared by dissolving a desired amount of either the galactomannan or glucomannan polymer in water (e.g., 10 g in 1000 mL water) to provide a solution and then adding cellulose fibers (e.g., 100 g) with mixing to provide a suspension. The treated fibers are obtained by filtration and drying (e.g., 10% by weight galactomannan or glucomamnat polymer treated cellulose).

The preparations of representative fibrous superabsorbent composites are described in Examples 8-11. The compositions and liquid absorbent characteristics of representative fibrous superabsorbent composites are summarized in the Table 2. The representative composites were prepared by combining a CMC/galactomannan flake (94% CMC 9H4F/5.6% guar gum) with galactomannan treated cellulose fibers (northern kraft spruce pulp treated with 10 weight % guar gum). In Table 2, "NKS pulp with 10% GG" refers to northern kraft spruce pulp treated with 10 weight % guar gum; "Crosslinking agent/2g" refers to the amount of crosslinking agent applied per 2 g product; "BA" refers to boric acid; "AZC" refers to ammonium zirconium carbonate; and "BAC" refers to "bismuth ammonium citrate." For the CMC/galactomannan flake and the galactomannan treated cellulose, the values in parentheses refer to the relative weight of each in the composite superabsorbent fiber (wgt % total wgt).

Test Methods

Free Swell and Centrifuge Retention Capacities

The materials, procedure, and calculations to determine free swell capacity (g/g) and centrifuge retention capacity (CRC) (g/g) were as follows.

Test Materials:

Japanese pre-made empty tea bags (available from Drugstore.com, IN PURSUIT OF TEA polyester tea bags 93 mm×70 mm with fold-over flap (http:www.mesh.ne.jp/tokiwa/)).

Balance (4 decimal place accuracy, 0.0001 g for air-dried superabsorbent polymer (ADS SAP) and tea bag weights); timer; 1% saline; drip rack with clips (NLM 211); and lab centrifuge (NLM 211, Spin-X spin extractor, model 776S, 3,300 RPM, 120v).

Test Procedure:

1. Determine solids content of ADS.
2. Pre-weigh tea bags to nearest 0.0001 g and record.
3. Accurately weigh 0.2025 g±0.0025 g of test material (SAP), record and place into pre-weighed tea bag (air-dried (AD) bag weight). (ADS weight+AD bag weight=total dry weight).
4. Fold tea bag edge over closing bag.
5. Fill a container (at least 3 inches deep) with at least 2 inches with 1% saline.
6. Hold tea bag (with test sample) flat and shake to distribute test material evenly through bag.
7. Lay tea bag onto surface of saline and start timer.
8. Soak bags for specified time (e.g., 30 minutes).
9. Remove tea bags carefully, being careful not to spill any contents from bags, hang from a clip on drip rack for 3 minutes.
10. Carefully remove each bag, weigh, and record (drip weight).
11. Place tea bags onto centrifuge walls, being careful not to let them touch and careful to balance evenly around wall.
12. Lock down lid and start timer. Spin for 75 seconds.
13. Unlock lid and remove bags. Weigh each bag and record weight (centrifuge weight).

Calculations:

The tea bag material has an absorbency determined as follows:

Free Swell Capacity, factor=5.78

Centrifuge Capacity, factor=0.50

Z=Oven dry SAP wt (g)/Air dry SAP wt (g)

Free Capacity (g/g):

$$\frac{[(\text{drip wt (g)} - \text{dry bag wt (g)}) - (AD\ SAP\ \text{wt (g)})] - (\text{dry bag wt (g)} * 5.78)}{(AD\ SAP\ \text{wt (g)} * Z)}$$

Centrifuge Retention Capacity (g/g):

$$\frac{[\text{centrifuge wt (g)} - \text{dry bag wt (g)} - (AD\ SAP\ \text{wt (g)})] - (\text{dry bag wt (g)} * 0.50)}{(AD\ SAP\ \text{wt} * Z)}$$

Absorbency Under Load (AUL)

The materials, procedure, and calculations to determine AUL were as follows.

Test Materials:

Mettler Toledo PB 3002 balance and BALANCE-LINK software or other compatible balance and software. Software set-up: record weight from balance every 30 sec (this will be a negative number. Software can place each value into EXCEL spreadsheet.

Kontes 90 mm ULTRA-WARE filter set up with fritted glass (coarse) filter plate clamped to stand; 2 L glass bottle with outlet tube near bottom of bottle; rubber stopper with glass tube through the stopper that fits the bottle (air inlet); TYGON tubing; stainless steel rod/plexiglass plunger assembly (71 mm diameter); stainless steel weight with hole drill through to place over plunger (plunger and weight=867 g); VWR 9.0 cm filter papers (Qualitative 413 catalog number 28310-048) cut down to 80 mm size; double-stick SCOTCH tape; and 0.9% saline.

Test Procedure:

1. Level filter set-up with small level.
2. Adjust filter height or fluid level in bottle so that fritted glass filter and saline level in bottle are at same height.
3. Make sure that there are no kinks in tubing or air bubbles in tubing or under fritted glass filter plate.
4. Place filter paper into filter and place stainless steel weight onto filter paper.
5. Wait for 5-10 min while filter paper becomes fully wetted and reaches equilibrium with applied weight.
6. Zero balance.
7. While waiting for filter paper to reach equilibrium prepare plunger with double stick tape on bottom.
8. Place plunger (with tape) onto separate scale and zero scale.
9. Place plunger into dry test material so that a monolayer of material is stuck to the bottom by the double stick tape.
10. Weigh the plunger and test material on zeroed scale and record weight of dry test material (dry material weight 0.15 g±0.05 g).
11. Filter paper should be at equilibrium by now, zero scale.
12. Start balance recording software.
13. Remove weight and place plunger and test material into filter assembly.
14. Place weight onto plunger assembly.

15. Wait for test to complete (30 or 60 min)

16. Stop balance recording software.

Calculations:

A=balance reading (g) * −1 (weight of saline absorbed by test material)

B=dry weight of test material (this can be corrected for moisture by multiplying the AD weight by solids %).

$$AUL(g/g)=A/B(g\ 1\%\ saline/1\ g\ test\ material)$$

The following examples are provided for the purpose of illustrating, not limiting, the invention.

EXAMPLES

Example 1

The Preparation of Representative Superabsorbent Particles (Flakes)

Ammonium Zirconium Carbonate and Boric Acid Crosslinking

In this example, the preparation of representative superabsorbent composite crosslinked with ammonium zirconium carbonate is described.

Prepare a solution of CMC 9H4F 10.0 g OD in 900 ml deionized water with vigorous stirring to obtain a smooth solution. Fully dissolve 0.6 g guar gum in 50 ml DI water and mix well with the CMC solution. Mix the solution for further one hour to allow complete mixing of the two polymers.

Blend the polymer mixture in the blender for 5 minutes. Fully dissolve boric acid 0.1 g in 30 ml DI water. Dilute 2.0 g ammonium zirconium carbonate solution (15% $ZrO_2$) with 20 ml DI water. Transfer ammonium zirconium carbonate solution and boric acid solution to the polymer solution and blend for 5 minutes. Pour the gel into a Teflon coated pan and dry in the oven at 60° C. Grind the dry film in a coffee grinder and sieve. Collect 300-800 μm fraction for testing.

T-bag test for free swell 45.87 g/g; centrifuge capacity 26.11 g/g; and AUL 26.57 g/g (at 0.3 psi) for 0.9% saline solution.

Example 2

The Preparation of Representative Superabsorbent Particles (Flakes)

Aluminum Sulfate/Boric Acid Crosslinking

In this example, the preparation of representative superabsorbent composite crosslinked with aluminum sulfate and boric acid is described.

Prepare a solution of CMC 9-44F 10.0 g OD in 900 ml deionized water with vigorous stirring to obtain a solution. Dissolve 0.6 g guar gum in 50 ml DI water and mix well with the CMC solution. Mix the solution for further one hour to allow complete mixing of the two polymers.

Blend the polymer mixture in the blender for 5 minutes. Fully dissolve boric acid 01 g in 30 ml DI water. Dissolve 0.4 g aluminum sulfate octadecahydrate 20 ml DI water. Transfer boric acid solution and aluminum sulfate solution to the polymer solution and blend for 5 minutes to mix well. Pour the gel into a Teflon coated pan and dry in the oven at 60° C. Grind the dry film in a coffee grinder and sieve. Collect 300-800 μm fraction for testing.

T-bag test for free swell 46.83 g/g; centrifuge capacity 27.35 g/g; and AUL 29.13 g/g (at 0.3 psi) for 0.9% saline solution.

Example 3

The Preparation of Representative Superabsorbent Particles (Flakes)

Tyzor TE and Boric Acid Crosslinking

In this example, the preparation of representative superabsorbent composite crosslinked with Tyzor TE and boric acid is described.

Prepare a solution of CMC 9H4F 10.0 g OD in 900 ml deionized water with vigorous stirring to obtain a smooth solution. Dissolve 0.6 g guar gum in 50 ml DI water and mix well with the CMC solution. Mix the solution for further one hour to allow complete mixing of the two polymers.

Blend the polymer mixture in the blender for 5 minutes. Dissolve boric acid 0.2 g in 30 ml DI water. Dilute 0.2 g Tyzor TE with 20 ml DI water. Transfer Tyzor TE solution and boric acid solution to the polymer solution and blend for 5 minutes to mix well. Pour the gel into a Teflon coated pan and dry in the oven at 60° C. Grind the dry film in a coffee grinder and sieve. Collect 300-800 μm fraction for testing.

T-bag test for free swell 43.92 g/g; centrifuge capacity 24.46 g/g; and AUL 23.17 g/g (at 0.3 psi.) for 0.9 saline solution.

Example 4

The Preparation of Representative Superabsorbent Particles (Flakes)

Aluminum Sulfate and Boric Acid Crosslinking

In this example, the preparation of representative superabsorbent composite crosslinked with aluminum sulfate and boric acid is described.

Prepare a solution of CMC 9H4F 10.0 g OD in 900 ml deionized water with vigorous stirring to obtain a solution. Dissolve 0.6 g locust bean gum in 50 ml DI water and mix well with the CMC solution. Mix the solution for further one hour to allow complete mixing of the two polymers.

Blend the polymer mixture in the blender for 5 minutes. Dissolve boric acid 0.1 g in 30 ml DI water. Dissolve 0.6 g aluminum sulfate octadecahydrate in 20 ml DI water. Transfer boric acid solution and aluminum sulfate solution to the polymer solution and blend for 5 minutes to mix well. Pour the gel into a Teflon coated pan and dry in the oven at 60° C. Grind the dry film in a coffee grinder and sieve. Collect 300-800 μm fraction for testing.

T-bag test for free swell 44.62 g/g; centrifuge capacity 25.09 g/g; and AUL 27.66 g/g (at 0.3 psi) for 0.9% saline.

Example 5

The Preparation of Representative Superabsorbent Particles (Flakes)

Ammonium Zirconium Carbonate and Boric Acid Crosslinking

In this example, the preparation of representative superabsorbent composite crosslinked with ammonium zirconium carbonate is described.

Prepare a solution of CMC 9H4F 10.0 g OD (11.1 g) in 900 ml deionized water with vigorous stirring to obtain a solution. Dissolve 0.6 g locust bean gum in 50 ml DI water and mix well with the CMC solution. Mix the solution for one hour to allow complete mixing of the two polymers.

Blend the polymer mixture in the blender for 5 minutes. Dissolve boric acid 0.1 g in 30 ml DI water. Dilute 2.0 g ammonium zirconium carbonate solution (15% $ZrO_2$) with 20 ml DI water. Transfer ammonium zirconium carbonate and boric acid solution to the polymer solution and blend for 5 minutes to mix well. Pour the gel into a Teflon coated pan and dry in the oven at 60° C. Grind the dry film in a coffee grinder and sieve. Collect 300-800 μm fraction for testing.

T-bag test for free swell 35.58 g/g; centrifuge capacity 19.56 g/g; and AUL 28.8 g/g (at 0.3 psi) for 0.9% saline solution.

Example 6

The Preparation of Representative Superabsorbent Particles (Flakes)

Aluminum Acetate and Boric Acid Crosslinking

In this example, the preparation of representative superabsorbent composite crosslinked with aluminum acetate and boric acid is described.

Prepare a solution of CMC 9H4F 40.0 g OD in 3600 ml deionized water with vigorous stirring to obtain a solution. Dissolve 2.4 g guar gum in 350 ml DI water and mix well with the CMC solution. Mix the solution for one hour to allow complete mixing of the two polymers.

Dissolve 0.15 g aluminum acetate/boric acid (Aldrich) in 50 ml water. Transfer aluminum acetate/boric acid solution to the polymer solution and blend for 5 minutes to mix well. Pour the gel into a Teflon coated pan and dry in the oven at 60° C. Grind the dry film in a coffee grinder and sieve. Collect 300-800 μm fraction for testing.

T-bag test for free swell 86.79 g/g; centrifuge capacity 65.85 g/g; and AUL 27.66 g/g (at 0.3 psi) for 0.9% saline solution.

Example 7

The Preparation of Representative Guar Gum Treated Cellulose Fibers

In this example, the preparation of representative guar gum treated cellulose fibers is described.

Guar gum (4.0 g) was dissolved in 3200 ml of deionized water. Northern kraft spruce (NKS) pulp (40.0 g) was dispersed in the guar gum solution and oven dried at 105° C. This material was used for binding superabsorbent composite particles.

Example 8

The Preparation of a Representative Fibrous Superabsorbent Composite

In this example, the preparation of a representative fibrous superabsorbent composite containing cellulose crosslinked with boric acid is described.

Boric acid 0.2 g was dissolved in 50 ml of deionized water at 25° C. Guar gum treated cellulose fiber (prepared as described above) 2.0 g was then dispersed in the boric acid solution for 15 minutes. Superabsorbent particles (prepared as described in Example 6) 2.0 g was added to the fiber slurry and mixed for 2 minutes. To the swollen mass of fiber gel was added 150 ml of isopropanol and mixed for 5 minutes and filtered to obtain the fibrous composite formed. The fibrous composite was partially dried in the oven at 66° C. The partially-dried fiber mass was fiberized and then dried in the oven at 66° C.

T-bag test gave free swell of 54.73 g/g; centrifuge capacity of 31.42 g/g; and AUL of 17.84 g/g (at 0.3 psi) for 0.9% saline solution.

Example 9

The Preparation of a Representative Fibrous Superabsorbent Composite

In this example, the preparation of a representative fibrous superabsorbent composite containing cellulose crosslinked with ammonium zirconium carbonate is described.

Ammonium zirconium carbonate aqueous solution (15% $ZrO_2$) 0.8 g was dissolved in 50 ml of deionized water at 80° C. Guar gum treated cellulose fiber (prepared as described above) 2.0 g was then dispersed in the ammonium zirconium carbonate solution for 15 minutes. Superabsorbent particles (prepared as described in Example 6) 2.0 g was added to the fiber slurry and mixed for 2 minutes. To the swollen mass of fiber gel was added 150 ml of isopropanol and mixed for 5 minutes and filtered to obtain the fibrous composite. The fibrous composite was partially dried in the oven at 66° C. The fiber mass was then fiberized and dried in the oven at 66° C.

T-bag test gave free swell of 53.51 g/g; centrifuge capacity of 28.52 g/g; and AUL of 20.35 g/g (at 0.3 psi) for 0.9% saline solution.

Example 10

The Preparation of a Representative Fibrous Superabsorbent Composite

In this example, the preparation of a representative fibrous superabsorbent composite containing cellulose crosslinked with aluminum sulfate and boric acid is described.

Aluminum sulfate octadecahydrate 0.035 g was dissolved in 50 ml of deionized water at 80° C. Guar gum treated cellulose fiber (prepared as described above) 2.0 g was then dispersed in the aluminum sulfate solution for 15 minutes. Superabsorbent particles (prepared as described in Example 6) 2.0 g was added to the fiber slurry and mixed for 2 minutes. To the swollen mass of fiber gel was added 150 ml of isopropanol and mixed for 15 minutes and filtered to obtain composite fiber. The fiber mass was partially dried in the oven at 66° C. The fiber mass was then fiberized and dried in the oven at 66° C.

T-bag test gave free swell of 46.01 g/g; centrifuge capacity of 19.99 g/g; and AUL of 22.53 g/g (at 0.3 psi) for 0.9% saline solution.

Example 11

The Preparation of a Representative Fibrous Superabsorbent Composite

In this example, the preparation of a representative fibrous superabsorbent composite containing cellulose crosslinked with bismuth ammonium carbonate is described.

Bismuth ammonium carbonate 1.3 g was mixed in 50 ml of deionized water at 80° C. to form a partial suspension. Guar gum treated cellulose fiber (prepared as described above) 2.0 g was then dispersed in the bismuth ammonium carbonate solution for 15 minutes. Superabsorbent particles (prepared as described in Example 6) 2.0 g was added to the fiber slurry and mixed for 2 minutes. To the swollen mass of fiber gel was added 150 ml of isopropanol and mixed for 5 minutes and filtered to obtain the fibrous composite. The fibrous composite was partially dried in the oven at 66° C. The fiber mass was then fiberized and dried in the oven at 66° C.

T-bag test gave free swell of 50.29 g/g; centrifuge capacity of 30.23 g/g; and AUL of 18.40 g/g (at 0.3 psi) for 0.9% saline solution.

In Tables 1 and 2: A1 acetate/boric acid is dihydroxy aluminum acetate ⅓ boric acid from Aldrich Chemical Co.

TABLE 1

Superabsorbent Flakes From Crosslinked Aqueous Mixtures of CMC and Galactomannans

| Sample | CMC | Galactomannan (wgt % total wgt) | Crosslinking agent (wgt % total wgt, applied) | Free Swell (g/g) | CRC (g/g) | AUL (g/g) |
|---|---|---|---|---|---|---|
| 1 | CMC 9H4F | Guar Gum 5.5% | (AZC)Zr 1.38%, $Na_2B_4O_7$ 0.9% | 73.28 | 33.75 | 23.26 |
| 2 | CMC 9H4F | Guar Gum 5.4% | (AZC)Zr 2.72%, $Na_2B_4O_7$ 0.9% | 51.57 | 33.42 | 24.95 |
| 3 | CMC 9H4F | Guar Gum 5.4% | (AZC)Zr 4.0%, $Na_2B_4O_7$ 0.9% | 37.07 | 19.95 | 25.86 |
| 4 | CMC 9H4F | Guar Gum 5.3% | (AZC)Zr 5.3% | 25.79 | 11.1 | 21.93 |
| 5 | CMC 9H4F | Guar Gum 5.5% | (AZC)Zr 1.36%, $B(OH)_3$ 1.8% | 60.02 | 41.41 | 27.4 |
| 6 | CMC 9H4F | Guar Gum 5.4% | (AZC)Zr 1.35%, $B(OH)_3$ 2.7% | 64.29 | 45.82 | 27.04 |
| 7 | CMC 9H4F | Guar Gum 5.4% | (AZC)Zr 2.72%, $B(OH)_3$ 0.9% | 45.87 | 26.11 | 26.57 |
| 8 | CMC 9H4F | Guar Gum 5.5% | (AZC)Zr 2.75% | 47.79 | 28.92 | 27.13 |
| 9 | CMC 9H4F | Guar Gum 5.4% | $Al_2(SO_4)_3$ 2.72%, $B(OH)_3$ 0.9% | 43.81 | 23.08 | 28.02 |
| 10 | CMC 9H4F | Guar Gum 5.4% | $Al_2(SO_4)_3$ 1.83%, $B(OH)_3$ 0.9% | 46.83 | 27.35 | 29.13 |
| 11 | CMC 9H4F | Guar Gum 5.4% | $Al_2(SO_4)_3$ 0.9%, $B(OH)_3$ 0.9% | 64.36 | 51.18 | 27.51 |
| 12 | CMC 9H4F | Guar Gum 5.4% | $Al_2(SO_4)_3$ 2.75% | 50 | 32.81 | 23.62 |
| 13 | CMC 9H4F | Guar Gum 5.3% | $Al_2(SO_4)_3$ 2.6%, Tyzor TE 4.2% | 43.92 | 24.46 | 23.17 |
| 14 | CMC 9H4F | Guar Gum 5.8% | $Al_2(SO_4)_3$ 1.8%, Tyzor TE 4.2% | 55.58 | 24.46 | 26.4 |
| 15 | CMC 9H4F | Guar Gum 5.9% | $Al_2(SO_4)_3$ 1.0%, Tyzor TE 4.3% | 72.93 | 39.47 | 25.4 |
| 16 | CMC 9H4F | Guar Gum 5.1% | $Al_2(SO_4)_3$ 2.5%, Tyzor TE 6.8% | 46.71 | 52.01 | 22.62 |
| 17 | CMC 9H4F | LB Gum 5.4% | $Al_2(SO4)_3$ 2.72%, $B(OH)_3$ 0.9% | 44.62 | 25.09 | 27.66 |
| 18 | CMC 9H4F | LB Gum 5.4% | $Al_2(SO_4)_3$ 1.83%, $B(OH)_3$ 0.9% | 46.15 | 28.28 | 27.57 |
| 19 | CMC 9H4F | LB Gum 5.4% | $Al_2(SO_4)_3$ 0.9%, $B(OH)_3$ 0.9% | 54.91 | 37.93 | 29.13 |
| 20 | CMC 9H4F | LB Gum 5.4% | $Al_2(SO_4)_3$ 2.75% | 47.12 | 27.72 | 28.26 |
| 21 | CMC 9H4F | LB Gum 5.4% | (AZC)Zr 1.36%, $B(OH)_3$ 1.8% | 52.13 | 35.37 | 31.88 |
| 22 | CMC 9H4F | LB Gum 5.4% | (AZC)Zr 1.35%, $B(OH)_3$ 2.7% | 53.64 | 36.59 | 31.15 |
| 23 | CMC 9H4F | LB Gum 5.4% | (AZC)Zr 2.72%, $B(OH)_3$ 0.9% | 35.58 | 19.56 | 28.8 |
| 24 | CMC 9H4F | LB Gum 5.4% | (AZC)Zr 2.75% | 37.59 | 19.74 | 28.91 |
| 25 | CMC 9H4F | LB Gum 5.4% | (AZC)Zr 2% | 44.79 | 26.6 | 26.6 |
| 26 | CMC 9H4F | LB Gum 5.4% | Al Acetate/Boric acid 2% | 36.41 | 18.33 | 26.66 |
| 27 | CMC 9H4F | LB Gum 5.4% | Al Acetate/Boric acid 3% | 30.36 | 13.57 | 26.06 |
| 28 | CMC 9H4F | LB Gum 5.4% | Al Acetate/Boric acid 5% | 30.17 | 12.74 | 23.46 |
| 29 | CMC 9H4F | LB Gum 5.4% | Al Acetate/Boric acid 0.25% | 70.12 | 54.1 | 31.46 |
| 30 | CMC 9H4F | LB Gum 5.4% | Al Acetate/Boric acid 0.5% | 57.96 | 40.74 | 29.37 |
| 31 | CMC 9H4F | LB Gum 5.4% | Al Acetate/Boric acid 1% | 50.24 | 29.48 | 30.24 |
| 32 | CMC 9H4F | LB Gum 5.4% | Al Acetate/Boric acid 1.5% NS | 43.73 | 24.23 | 27.55 |
| 33 | PA-CMC | Guar Gum 5.4% | $Al_2(SO_4)_3$ 2.72%, $B(OH)_3$ 0.9% | 32.74 | 14.43 | 29.44 |
| 34 | PA-CMC | Guar Gum 5.4% | $Al_2(SO_4)_3$ 1.83%, $B(OH)_3$ 0.9% | 39.84 | 19.44 | 27.64 |
| 35 | PA-CMC | Guar Gum 5.4% | $Al_2(SO_4)_3$ 0.9%, $B(OH)_3$ 0.9% | 49 | 30.12 | 25.73 |
| 36 | PA-CMC | Guar Gum 5.4% | $Al_2(SO_4)_3$ 2.75% | 41.5 | 22.72 | 26.08 |
| 37 | PA-CMC | Guar Gum 5.4% | $Al_2(SO_4)_3$ 2.72%, $B(OH)_3$ 0.9% | 29.33 | 11.64 | 30.91 |
| 38 | PA-CMC | Guar Gum 5.4% | $Al_2(SO_4)_3$ 1.83%, $B(OH)_3$ 0.9% | 32.14 | 13.29 | 27.44 |
| 39 | PA-CMC | Guar Gum 5.4% | $Al_2(SO_4)_3$ 0.9%, $B(OH)_3$ 0.9% | 35.41 | 13.81 | 26 |
| 40 | PA-CMC | Guar Gum 5.4% | $Al_2(SO_4)_3$ 2.75% | 36.5 | 13.96 | 30.42 |
| 41 | PA-CMC | Guar Gum 5.4% | $Al_2(SO_4)_3$ 2.72%, $B(OH)_3$ 0.9% | 33.21 | 13.65 | 27.66 |
| 42 | PA-CMC | Guar Gum 5.4% | $Al_2(SO_4)_3$ 1.83%, $B(OH)_3$ 0.9% | 36.21 | 16.43 | 28.13 |
| 43 | PA-CMC | Guar Gum 5.4% | $Al_2(SO_4)_3$ 0.9%, $B(OH)_3$ 0.9% | 47.45 | 26.51 | 27.06 |
| 44 | PA-CMC | Guar Gum 5.4% | $Al_2(SO_4)_3$ 2.75% | 41.12 | 19.08 | 28.02 |
| 45 | PA-CMC | Guar Gum 5.5% | (AZC) Zr 1.0%, $B(OH)_3$ 0.9% | 61.36 | 46.48 | 26.82 |
| 46 | PA-CMC | Guar Gum 5.5% | (AZC) Zr 1.5%, $B(OH)_3$ 0.9% | 58.7 | 43.08 | 24.84 |
| 47 | PA-CMC | Guar Gum 5.5% | (AZC) Zr 2.0%, $B(OH)_3$ 0.9% | 58.48 | 41.21 | 28.68 |
| 48 | PA-CMC | Guar Gum 5.5% | (AZC) Zr 2.5%, $B(OH)_3$ 0.9% | 40.26 | 23.83 | 25.95 |
| 49 | PA-CMC | Guar Gum 5.4% | $Al_2(SO_4)_3$ 2.72%, $B(OH)_3$ 0.9% | 64.35 | 49.81 | 25.8 |
| 50 | PA-CMC | Guar Gum 5.4% | $Al_2(SO_4)_3$ 1.83%, $B(OH)_3$ 0.9% | 68.85 | 54.48 | 24.06 |
| 51 | PA-CMC | Guar Gum 5.4% | $Al_2(SO_4)_3$ 0.9%, $B(OH)_3$ 0.9% | 75.38 | 56.35 | 22.86 |
| 52 | PA-CMC | Guar Gum 5.4% | $Al_2(SO_4)_3$ 2.75% | 50.54 | 33.92 | 26.35 |

TABLE 2

Composite Superabsorbent Fiber From CMC/Galactomannan Flakes and Galactomannan Treated Cellulose

| Sample | CMC/Galactomannan flake (wgt % total wgt) | Galactomannan treated cellulose (wgt % total wgt) | Crosslinking agent/2 g | Free Swell (g/g) | CRC (g/g) | AUL (g/g) |
|---|---|---|---|---|---|---|
| 1 | CMC 9H4F/Guar Gum (65%) | NKS pulp with 10% GG (35%) | 0.1 g BA (25° C.) | 54.69 | 30.24 | 18.2 |
| 2 | CMC 9H4F/Guar Gum (50%) | NKS pulp with 10% GG (50%) | 0.1 g BA (25° C.) | 54.73 | 31.42 | 17.84 |
| 3 | CMC 9H4F/Guar Gum (50%) | NKS pulp with 10% GG (50%) | 1.0 g AZC soln, (80° C.) | 28.39 | 5.81 | 15.8 |
| 4 | CMC 9H4F/Guar Gum (50%) | NKS pulp with 10% GG (50%) | 0.2 g $Al_2(SO_4)_3$, (80° C.) | 26.98 | 2.29 | 11.48 |
| 5 | CMC 9H4F/Guar Gum (50%) | NKS pulp with 10% GG (50%) | 0.4 g BAC (80° C.) | 51.57 | 28.28 | 17.64 |
| 6 | CMC 9H4F/Guar Gum (50%) | NKS pulp with 10% GG (50%) | 0.25 g AZC soln, (80° C.) | 49.22 | 27.39 | 16.84 |
| 7 | CMC 9H4F/Guar Gum (50%) | NKS pulp with 10% GG (50%) | 0.075 g $Al_2(SO_4)_3$, (80° C.) | 27.47 | 6.21 | 22 |
| 8 | CMC 9H4F/Guar Gum (50%) | NKS pulp with 10% GG (50%) | 0.035 g $Al_2(SO_4)_3$, (80 C.) | 37.95 | 11.56 | 23.51 |
| 9 | CMC 9H4F/Guar Gum (50%) | NKS pulp with 10% GG (50%) | 0.5 g BAC (80° C.) | 49.37 | 31.65 | 18.73 |
| 10 | CMC 9H4F/Guar Gum (50%) | NKS pulp with 10% GG (50%) | 0.1 g AZC soln, (80° C.) | 54.35 | 31.12 | 16.35 |
| 11 | CMC 9H4F/Guar Gum (50%) | NKS pulp with 10% GG (50%) | No X-Linker, (80° C.) | 53.64 | 34.44 | 22.35 |
| 12 | CMC 9H4F/Guar Gum (50%) | NKS pulp with 10% GG (50%) | 0.4 g AZC soln, (80° C.) | 53.51 | 28.52 | 20.35 |
| 13 | CMC 9H4F/Guar Gum (50%) | NKS pulp with 10% GG (50%) | 0.5 g AZC soln, (80° C.) | 44.6 | 19.22 | 18.51 |
| 14 | CMC 9H4F/Guar Gum (50%) | NKS pulp with 10% GG (50%) | 0.0175 g $Al_2(SO_4)_3$, (80° C.) | 46.01 | 19.99 | 22.53 |
| 15 | CMC 9H4F/Guar Gum (50%) | NKS pulp with 10% GG (50%) | 0.65 g BAC, (80° C.) | 50.29 | 30.23 | 18.4 |

While illustrative embodiments have been illustrated and described, it will be appreciated that various changes can be made therein without departing from the spirit and scope of the invention.

The embodiments of the invention in which an exclusive property or privilege is claimed are defined as follows:

1. A method for making a fibrous composite, comprising:

(a) blending a carboxyalkyl cellulose and a galactomannan polymer or a glucomannan polymer in water to provide an aqueous solution;

(b) treating the aqueous solution with a first crosslinking agent to provide a gel;

(c) drying the gel to provide a solid;

(d) comminuting the solid to provide a plurality of particles;

(e) combining at least a portion of the plurality of particles with an aqueous suspension comprising cellulose wood pulp fibers treated with a galactomannan polymer or a glucomannan polymer, and optionally a second crosslinking agent, to provide a mixture; and (f) mixing the mixture with a water-miscible solvent to provide a fibrous composite.

2. The method of claim 1 further comprising drying the fibrous composite to provide partially-dried fibrous composite.

3. The method of claim 2 further comprising fiberizing the partially-dried fibrous composite to provide partially-dried fiberized fibrous composite.

4. The method of claim 3 further comprising drying the partially-dried fiberized fibrous composite to provide dried fiberized fibrous composite.

5. The method of claim 1, wherein the carboxyalkyl cellulose has a degree of carboxyl group substitution of from about 0.3 to about 2.5.

6. The method of claim 1, wherein the carboxyalkyl cellulose is carboxymethyl cellulose.

7. The method of claim 1, wherein the galactomannan polymer is selected from the group consisting of guar gum, locust bean gum, and tara gum.

8. The method of claim 1, wherein the glucomannan polymer is konjac gum.

9. The method of claim 1, wherein the aqueous solution comprises from about 60 to about 99 percent by weight carboxyalkyl cellulose based on the total weight of particles.

10. The method of claim 1, wherein the aqueous solution comprises from about 1 to about 20 percent by weight galactomannan polymer or glucomannan polymer based on the total weight of particles.

11. The method of claim 1, wherein the first crosslinking agent is selected from the group consisting of aluminum (III) compounds, titanium (IV) compounds, bismuth (III) compounds, boron (III) compounds, and zirconium (IV) compounds.

12. The method of claim 1, wherein the first crosslinking agent is present in an amount from about 0.1 to about 20 percent by weight based on the total weight of particles.

13. The method of claim 1, wherein the cellulose wood pulp fibers treated with a galactomannan polymer or glucomannan polymer comprises cellulose wood pulp fibers treated with from about 1 to about 20 percent by weight galactomannan polymer or glucomannan polymer based on the weight of cellulose wood pulp fibers.

14. The method of claim 1, wherein the second crosslinking agent is selected from the group consisting of aluminum (III) compounds, titanium (IV) compounds, bismuth (III) compounds, boron (III) compounds, and zirconium (IV) compounds.

15. The method of claim 1, wherein the second crosslinking agent is present in an amount up to about 20 percent by weight based on the total weight of composite fibers.

16. The method of claim 1, wherein the water-miscible solvent is an alcohol.

17. The method of claim 1, wherein the water-miscible solvent is selected from the group consisting of methanol, ethanol, isopropanol, and mixtures thereof.

18. The method of claim 1, wherein the volume of water-miscible solvent to water is from about 1:1 to about 1:5.

* * * * *